US007984830B2

(12) United States Patent
Stradella

(10) Patent No.: US 7,984,830 B2
(45) Date of Patent: Jul. 26, 2011

(54) FLUID PRODUCT DISPENSING HEAD

(75) Inventor: Giuseppe Stradella, Camogli (IT)

(73) Assignee: Tebro S.A., Luxembourg (IT)

( * ) Notice: Subject to any disclaimer, the term of this patent is extended or adjusted under 35 U.S.C. 154(b) by 840 days.

(21) Appl. No.: 11/883,809

(22) PCT Filed: Feb. 20, 2006

(86) PCT No.: PCT/EP2006/060095

§ 371 (c)(1),
(2), (4) Date: Nov. 7, 2007

(87) PCT Pub. No.: WO2006/087385

PCT Pub. Date: Aug. 24, 2006

(65) Prior Publication Data

US 2008/0116223 A1 May 22, 2008

(30) Foreign Application Priority Data

Feb. 21, 2005 (FR) ..... 05 50465

(51) Int. Cl.
*B67B 1/00* (2006.01)

(52) U.S. Cl. ..... 222/153.13; 222/162; 222/182; 222/183; 222/384; 222/402.11; 222/562; 128/200.21

(58) Field of Classification Search ..... 222/153.01–153.14, 162, 182–183, 321.6, 384, 402.11, 222/562; 128/200.14, 200.21
See application file for complete search history.

(56) References Cited

U.S. PATENT DOCUMENTS

| | | | | |
|---|---|---|---|---|
| 3,904,088 | A | 9/1975 | Milbourne, Sr. | |
| 3,918,614 | A | 11/1975 | Steiman | |
| 4,334,638 | A * | 6/1982 | Stock | 222/153.1 |
| 6,364,166 | B1 * | 4/2002 | Ritsche et al. | 222/153.13 |
| 6,592,011 | B1 * | 7/2003 | Lammel et al. | 222/402.11 |
| 2004/0011819 | A1 * | 1/2004 | Jennings et al. | 222/162 |

FOREIGN PATENT DOCUMENTS

| | | | |
|---|---|---|---|
| DE | 2 104 606 | A1 | 8/1972 |
| FR | 2682305 | A1 * | 4/1993 |
| FR | 2 750 406 | A1 | 1/1998 |

* cited by examiner

*Primary Examiner* — Kevin P Shaver
*Assistant Examiner* — Andrew Bainbridge
(74) *Attorney, Agent, or Firm* — Sughrue Mion, PLLC

(57) ABSTRACT

A fluid dispenser device has a reservoir, a pump, a dispensing outlet, an actuator, and a removable cap. The actuator is integrally formed with the dispensing outlet in at least one embodiment. The cap has detents that project from the cap. The actuator is blocked from actuating by a blocking flange that is integrally connected with the dispensing outlet. The detents from the cap bend the blocking flange so that the reservoir can not move in relation to the dispensing outlet when the cap is in a closed position. When the cap is removed, the detents no longer bend the blocking flange, and the actuator can then move the reservoir in relation to the dispensing outlet and affect dispensation. In at least one embodiment the actuator is not axially aligned with the dispensing outlet.

20 Claims, 2 Drawing Sheets

FLUID PRODUCT DISPENSING HEAD

The present invention relates to a fluid dispenser device, and more particularly to such a device provided with a system preventing said device from being actuated accidentally.

A fluid dispenser device, in particular for dispensing pharmaceuticals, or for use in the fields of perfumery or cosmetics, generally comprises one or more reservoirs containing the fluid, and a dispenser member, such as a pump or a valve, mounted on said reservoir. A dispenser head provided with a dispenser orifice is assembled on the pump or the valve so as to dispense the content of the reservoir. Generally, the head is axially displaceable relative to the reservoir, so as to actuate the pump or the valve. Nowadays, it is common to use portable devices so as to make it possible to use the dispenser device whenever or wherever desired. Such devices are therefore generally transportable, e.g. in a handbag, a pocket, or the like. In this event, the problem exists of the device being actuated accidentally while it is being transported or stored in said handbag. Generally, in order to avoid the device being actuated accidentally, a system is provided that the user must manipulate before being able to use the device. Pull-tab or slide systems that prevent the device from being actuated are well known. However, such devices are relatively complex to manufacture and to assemble, and they require the user to perform specific hand movements in order to be able to use the device.

An object of the invention is to provide a fluid dispenser device that does not have the above-mentioned drawbacks.

In particular, an object of the present invention is to provide a fluid dispenser device that can effectively prevent accidental actuation, regardless of how the device is actuated.

Another object of the present invention is to provide such a fluid dispenser device that does not require any specific manipulation linked to the anti-actuation system.

Another object of the present invention is to provide such a fluid dispenser device that does not require any modification to existing standard reservoirs and pumps or valves, and that, on the contrary, adapts easily to existing devices.

Another object of the present invention is to provide such a fluid dispenser device that is simple and inexpensive to manufacture and to assemble.

The present invention thus provides a fluid dispenser device comprising: a reservoir containing the fluid; a dispenser head provided with a dispenser orifice, said dispenser head being displaceable relative to said reservoir so as to dispense the fluid through said dispenser orifice; and a removable protective cap that is displaceable between a closed position, in which it covers said dispenser orifice, and an open position, in which it uncovers said dispenser orifice; said device further comprising blocking means that are displaceable and/or deformable between a blocking position, in which they prevent fluid from being dispensed, and a release position, in which they do not prevent fluid from being dispensed, said blocking means being displaced and/or deformed into their blocking position by said protective cap in its closed position.

Advantageously, said blocking means are resiliently urged towards their release position, such that the displacement of the protective cap towards its open position automatically causes said blocking means to be displaced and/or deformed towards their release position.

Advantageously, in the blocking position, said blocking means co-operate firstly with said dispenser head or with an element secured thereto, and secondly with said reservoir or with an element secured thereto, for substantially preventing mutual displacement thereof.

Advantageously, said blocking means are secured to said dispenser head.

Advantageously, said blocking means are made integrally with said dispenser head.

Advantageously, said blocking means comprise at least one substantially rigid blocking element that is connected via a substantially flexible hinge to a substantially rigid support portion.

Advantageously, said support portion is secured to said dispenser head, and in particular is integral therewith.

Advantageously, said hinge comprises a bridge of elastically-deformable material that forms a pivot hinge for pivoting said blocking element about said support element.

Advantageously, in the blocking position, each blocking element co-operates firstly with the reservoir or with an element secured thereto, and secondly directly with its corresponding support portion.

Advantageously, said blocking means include cam means, and said protective cap includes control means, said control means co-operating with said cam means so as to displace and/or deform said blocking means into their blocking position, when said protective cap is brought into its closed position.

Advantageously, said dispenser head includes at least one opening through which said control means of said protective cap pass, while said protective cap is being brought into its closed position.

Advantageously, each blocking element includes a cam surface that co-operates with a corresponding control projection of said protective cap.

Advantageously, a pump or a valve is assembled on said reservoir by means of a fastener ring, said blocking means, in their blocking position, co-operating with said fastener ring.

In a first variant embodiment of the invention, fluid is dispensed while the user manually displaces the dispenser head axially relative to the reservoir.

In a variant, the device includes lateral actuator means.

Advantageously, said lateral actuator means comprise a manual actuator element that is mounted to pivot about said dispenser head, and that co-operates with said reservoir or with an element secured thereto.

Advantageously, an actuator member is pivotally mounted on said manual actuator element, said actuator member co-operating with said reservoir or with an element secured thereto, so as to displace said reservoir relative to said dispenser head, while said manual actuator element is being actuated by the user.

Advantageously, said blocking means comprise two diametrally-opposite blocking elements.

Advantageously, said blocking means are formed on said dispenser head.

Other characteristics and advantages of the present invention appear more clearly from the following detailed description of two embodiments thereof, given by way of non-limiting example, and with reference to the accompanying drawings, in which.

Figure 1:
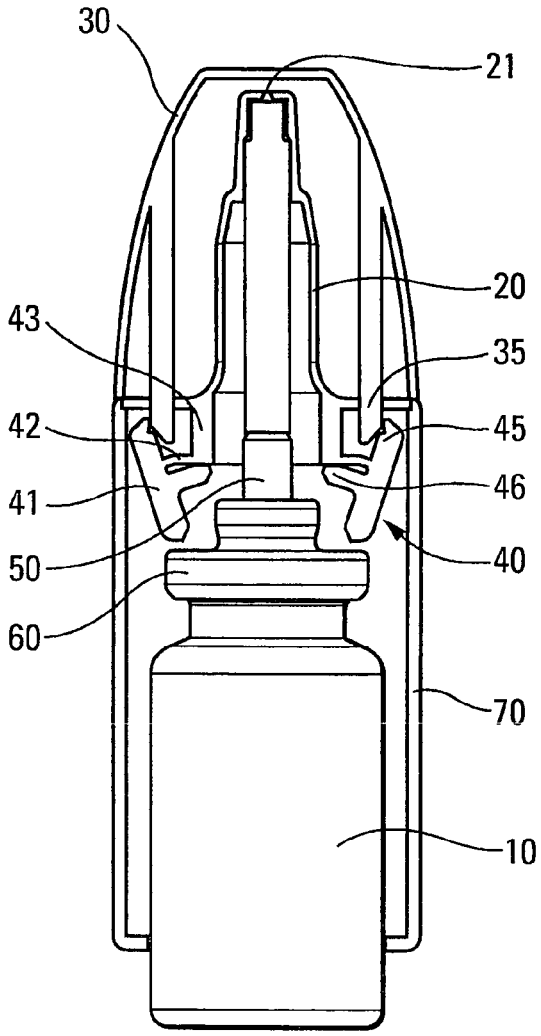
FIG. 1 is a diagrammatic section view of a fluid dispenser device constituting a first embodiment of the invention, in the blocking position.

With reference to the figures, a fluid dispenser device generally includes a reservoir 10 on which a pump or a valve 50 can be mounted, e.g. by means of a fastener ring 60, such as a crimp-fastener, snap-fastener, or screw-fastener ring. Since these various elements are not directly involved in the invention, they are not described in greater detail below. Naturally, the invention also applies to devices including a plurality of separate reservoirs.

A dispenser head 20 is assembled on the reservoir, preferably on the pump or the valve 50, said head being axially displaceable relative to said reservoir so as to dispense a dose of the fluid contained in the reservoir. The dispenser head 20 includes a dispenser orifice 21 through which the fluid can be dispensed. A protective cap 30 is also provided to protect the dispenser head 20, and, in particular, to cover the dispenser orifice 21 while the cap is in its closed position. In order to dispense the fluid, the user removes the cap 30 so as to uncover the dispenser orifice 21 and allow dispensing to take place. It should be observed that the dispenser head of the two embodiments shown in the figures is of nasal type, but the present invention could apply to any type of dispenser head. In addition, the protective cap 30 is shown as being completely separable, but it could also be of the captive type, i.e. it could be permanently connected to the device, even in its open position.

In the invention, blocking means 40 are provided so as to prevent any accidental actuation, e.g. while the device is stored in a handbag or the like. The blocking means 40, preferably formed on the dispenser head 20, are displaceable and/or deformable between a blocking position, shown in FIGS. 1 and 3, in which they prevent fluid from being dispensed, and a release position, shown in FIGS. 2 and 4, in which fluid can be dispensed. The blocking means are displaced towards their blocking position by the protective cap 30, while it is being brought into its closed position. Advantageously, the blocking means 40 are resiliently urged towards their release position, such that when the user removes the protective cap 30, the blocking means are automatically displaced and/or deformed towards their release position (which is their rest position) without the user having to perform any manipulation other than removing the cap.

As can be seen in the figures, while in their blocking position, the blocking means preferably co-operate firstly with the dispenser head 20 or with an element secured thereto, and secondly with the reservoir 10 or with an element secured thereto, in particular the fastener ring 60, for substantially preventing mutual displacement, in particular axial displacement, of the dispenser head 20 relative to the reservoir 10. It should be understood that what is prevented in the embodiments shown, is any axial displacement that is sufficient to dispense the fluid contained in the reservoir 10. A very small axial displacement until the blocking means 40 come into abutment against the fastener ring 60 can obviously be envisaged.

The blocking means 40 are advantageously secured to the dispenser head 20, and they are preferably made integrally therewith, e.g. by molding or by overmolding. They advantageously comprise at least one blocking element 41. In the first embodiment shown in FIGS. 1 and 2, two diametrally-opposite blocking elements 41 are provided, whereas in the second embodiment shown in FIGS. 3 and 4, a single blocking element 41 is provided. Naturally, more than two blocking elements can also be envisaged. Each blocking element 41 is substantially rigid and is connected via a substantially flexible hinge 42 to a support portion 43 that is also substantially rigid. The support portion 43 is preferably secured to the dispenser head 20, and in particular is integral therewith. The flexible hinge 42 is preferably made in the form of a bridge of elastically-deformable material that forms a pivot hinge for pivoting the blocking element 41 about the support element 43. It is the hinge 42 that makes it possible both to deform and/or to displace the blocking element 41 towards its blocking position, and to return it automatically (under the effect of resilient deformation) towards its release position, while the cap is being removed from the head. Advantageously, in the blocking position, each blocking element 41 co-operates firstly with the reservoir 10 or with an element secured thereto, specifically the fastener ring 60, and secondly directly with its corresponding support portion 43. This configuration guarantees that in the event of accidental actuation, with the blocking means in the blocking position, no axial force is exerted on the flexible hinge. There is therefore no risk of said hinge being damaged. In the blocking position, the flexible hinge is subjected to its pivot deformation only. As shown in the figures, each blocking element 41 can advantageously include a projection 46 that bears against the support portion 43 while the blocking element 41 is in its blocking position. In the blocking position, in the event of accidental actuation, any axial displacement between the dispenser head 20 and the reservoir is therefore prevented by said blocking element 41 co-operating with said support portion 43, the elements being substantially rigid. While the blocking means 40 are in their release position, the blocking element 41 is in a position in which it can no longer co-operate with the fastener ring 60 in the event of the device being actuated.

Advantageously, the blocking means 40 include cam means 45, and said protective cap 30 includes control means 35. The cam means 45 are advantageously provided by a cam surface that is formed on each blocking element 41. The cam surface 45 can be formed on a projection of said blocking element 41. The control means 35 are advantageously formed inside the protective cap 30, and as many control means 35 can be provided as there are blocking elements 41. In a variant, it is also possible to provide a single common control element 35 that co-operates with the various blocking elements 41. The control means 35 are advantageously formed by an internal projection of the protective cap 30, which internal projection co-operates with said cam means 45 through an opening 25 provided in the dispenser head 20. While the cap is being put into its closed position, the control means 35 therefore pass through said opening 25 and come to co-operate with the cam surface 45 of the blocking element 41, so as to cause said blocking element to pivot about the flexible hinge 42, into the blocking position.

Figure 2:
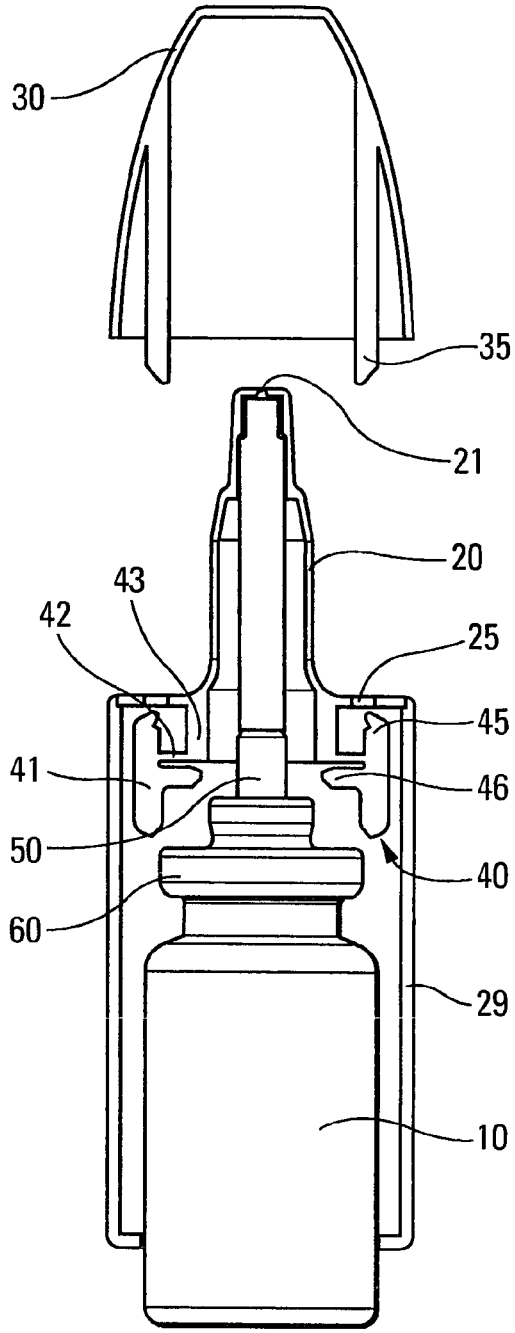
FIG. 2 is a view similar to the FIG. 1 view, in the release position.

FIGS. 1 and 2 show a first embodiment in which the actuator system is of the axial type. In this embodiment, when the user wishes to dispense a dose of the fluid, the user places fingers on the dispenser head 20 and exerts axial thrust on the reservoir 10, on the head 20, or on both, so as to actuate the pump 50 and dispense a dose contained in the reservoir 10. A body portion 70 is advantageously fastened, in particular snap-fastened, on the dispenser head 20 so as firstly to mask the blocking means 40, and also to form a protective casing for the entire device. After fastening, the body portion 70 is therefore secured to the head 20.

Figure 3:
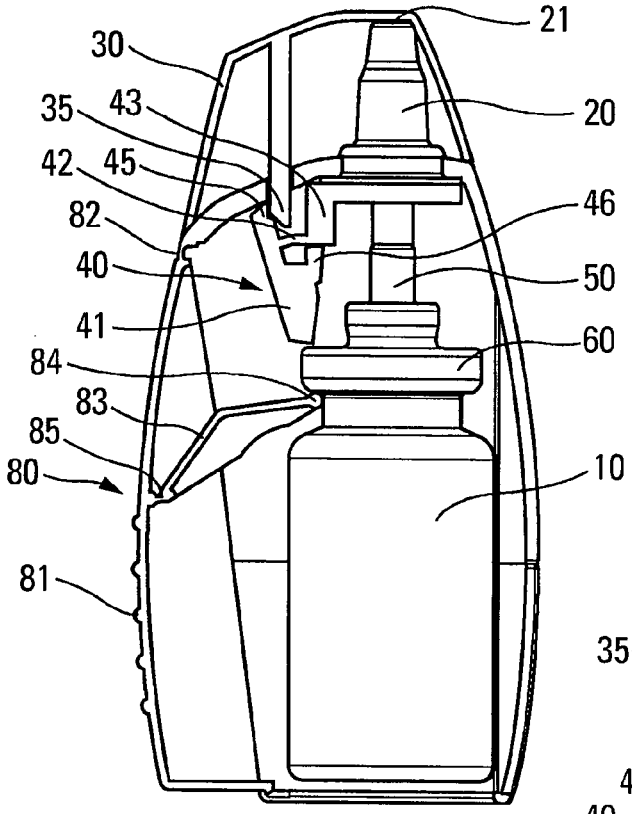
FIG. 3 is a diagrammatic section view of a fluid dispenser device constituting a second embodiment of the present invention, in the blocking position.
Figure 4:
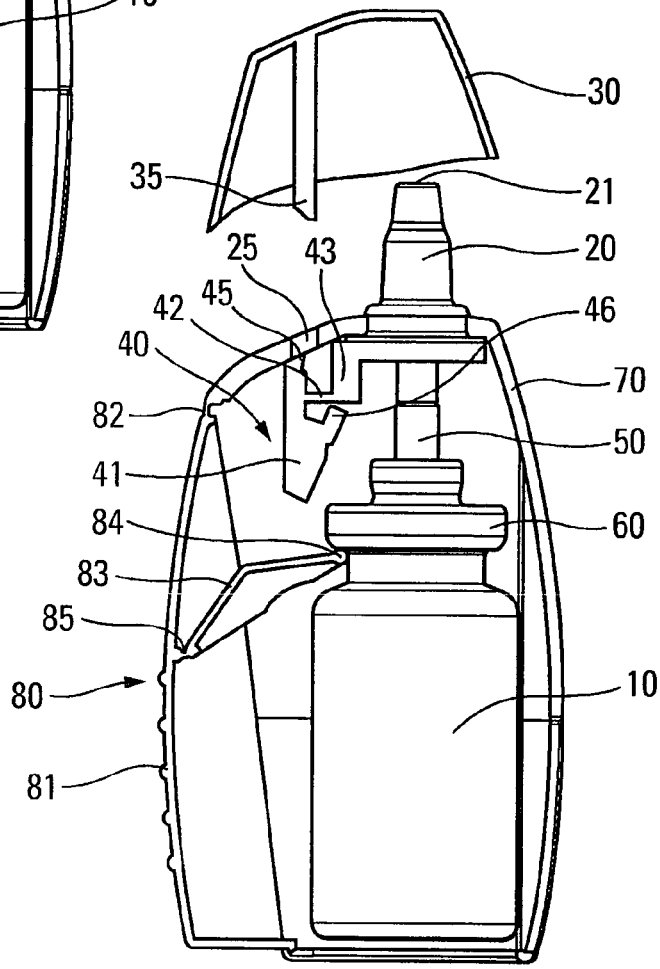
FIG. 4 is a view similar to the FIG. 3 view, in the release position.

FIGS. 3 and 4 show a second embodiment of the invention in which a lateral actuator system 80 is provided. In this second embodiment, a body 70 is also assembled on the dispenser head 20, in particular by snap-fastening, said body 70 being suitable for generally surrounding the entire reservoir 10, as shown in the figures. The lateral actuator system 80 advantageously comprises a manual actuator element 81 that is disposed laterally in said body 70 and that is mounted to pivot about said body. In a variant, the manual actuator element 81 could also be provided directly on the dispenser head 20. The manual actuator element 81 co-operates with the reservoir 10 or with an element secured thereto, specifically the fastener ring 60, so as to displace the reservoir 10 axially relative to the dispenser head 20. Advantageously, an actuator member 83 is pivotally mounted inside the manual actuator element 81, the end 84 of said actuator member 83 co-operating with the reservoir (or the fastener ring 60) so as to displace said reservoir. The manual actuator element 81 is therefore mounted to pivot about a first hinge 82, whereas the actuation member 83 is mounted to pivot about a second hinge 85. In particular, this makes it possible to actuate the fastener ring 60 from below without having to provide an add-on member that is to be fastened around the reservoir, around the fastener ring.

Other modifications are possible for the person skilled in the art, without going beyond the ambit of the present invention, as defined by the accompanying claims.

The invention claimed is:

1. A fluid dispenser device comprising:

a reservoir (10) containing the fluid;

a dispenser head (20) provided with a dispenser orifice (21), said dispenser head (20) being displaceable relative to said reservoir (10) so as to dispense the fluid through said dispenser orifice;

a removable protective cap (30) that is displaceable between a closed position, in which it covers said dispenser orifice (21), and an open position, in which it uncovers said dispenser orifice (21); and blocking means (40) formed integrally with said dispenser head (20), that is displaceable and/or deformable between a blocking position, in which said blocking means prevents fluid from being dispensed, and a release position, in which said blocking means does not prevent fluid from being dispensed, said blocking means (40) being displaced and/or deformed into the blocking position by said protective cap (30) in its closed position, wherein said blocking means (40) remains integrally formed with said dispenser head (20) in both the blocking position and the release position.

2. A device according to claim 1, in which said blocking means (40) are resiliently urged towards their release position, such that the displacement of the protective cap (30) towards its open position automatically causes said blocking means (40) to be displaced and/or deformed towards their release position.

3. A device according to claim 1, in which, in the blocking position, said blocking means (40) cooperate firstly with said dispenser head (20) or with an element secured thereto, and secondly with said reservoir (10) or with an element secured thereto, for substantially preventing mutual displacement thereof.

4. A device according to claim 1, in which said blocking means (40) are secured to said dispenser head (20).

5. A device according to claim 1, in which said blocking means (40) comprise at least one substantially rigid blocking element (41) that is connected via a substantially flexible hinge (42) to a substantially rigid support portion (43).

6. A device according to claim 5, wherein said support portion (43) is integral with said dispenser head (20).

7. A device according to claim 5, in which, said hinge (42) comprises a bridge of elastically deformable material that forms a pivot hinge for pivoting said blocking element (41) about said support element (43).

8. A device according to claim 5, in which, in the blocking position, each blocking element (41) co-operates firstly with the reservoir (10) or with an element secured thereto, and secondly directly with its corresponding support portion (43).

9. A device according to claim 1, in which said blocking means (40) include cam means (45) and said protective cap (30) includes control means (35), said control means (35) co-operating with said cam means (45) so as to displace and/or deform said blocking means (40) into their blocking position, when said protective cap (30) is brought into its closed position.

10. A device according to claim 9, in which said dispenser head (20) includes at least one opening (25) through which said control means (35) of said protective cap (30) pass, while said protective cap is being brought into its closed position.

11. A device according to claim 9 in which said blocking means comprise at least one substantially rigid blocking element that is connected via a substantially flexible hinge to a substantially rigid support portion and, in which each blocking element (41) includes a cam surface (45) that co-operates with a corresponding control projection (35) of said protective cap (30).

12. A device according to claim 1, in which a pump or a valve (50) is assembled on said reservoir (10) by means of a fastener ring (60), said blocking means (40), in their blocking position, co-operating with said fastener ring (60).

13. A device according to claim 1, in which fluid is dispensed while the user manually displaces the dispenser head (20) axially relative to the reservoir.

14. A device according to claim 1, including lateral actuator means (80).

15. A device according to claim 14, in which said lateral actuator means (80) comprises a manual actuator element (81) that is mounted to pivot about said dispenser head (20), and that co-operates with said reservoir (10) or with an element secured thereto.

16. A device according to claim 15, in which an actuator member (83) is pivotally mounted on said manual actuator element (81), said actuator member (83) co-operating with said reservoir (10) or with an element secured thereto, so as to displace said reservoir (10) relative to said dispenser head (20), while said manual actuator element (81) is being actuated by the user.

17. A device according to claim 1, in which said blocking means (40) comprise two diametrally opposite blocking elements (41).

18. A device according to claim 1, in which said blocking means (40) are formed on said dispenser head (20).

19. A fluid dispenser device, comprising:

a reservoir (10) for containing a fluid;

a dispenser head (20) including a dispenser orifice (21) and a blocking mechanism (40), said dispenser head (20) being displaceable relative to said reservoir (10) so as to dispense the fluid through said dispenser orifice; and a removable protective cap (30) being displaceable between a closed position, in which it covers said dispenser orifice (21), and an open position, in which it uncovers said dispenser orifice (21); and wherein said blocking mechanism (40) is displaceable and/or deformable between a blocking position, in which said blocking mechanism prevents a displacement between said dispenser head and said reservoir necessary to dispense the fluid, and a release position, in which said blocking mechanism does not prevent said displacement, wherein said blocking mechanism (40) is displaced and/or deformed into the blocking position by said protective cap (30) in its closed position and said blocking mechanism (40) being displaced and/or deformed into the release position by said protective cap (30) in its open position.

20. The fluid dispenser according to claim 19, wherein said blocking mechanism (40) includes a pivot hinge (42) for pivoting the blocking mechanism (40) into the release position automatically upon removal of said protective cap, and for pivoting the blocking mechanism (40) into the blocking position automatically upon movement of said protective cap (30) into its closed position.

* * * * *